US009535381B2

(12) United States Patent
Miyahara et al.

(10) Patent No.: US 9,535,381 B2
(45) Date of Patent: Jan. 3, 2017

(54) ELECTROPHOTOGRAPHIC MEMBER AND METHOD FOR PRODUCING THE SAME

(71) Applicant: CANON KABUSHIKI KAISHA, Tokyo (JP)

(72) Inventors: Yasuhiro Miyahara, Tokyo (JP); Naoki Akiyama, Toride (JP); Akiyoshi Shinagawa, Kasukabe (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/060,003

(22) Filed: Mar. 3, 2016

(65) Prior Publication Data

US 2016/0259276 A1 Sep. 8, 2016

(30) Foreign Application Priority Data

Mar. 5, 2015 (JP) ..... 2015-044051

(51) Int. Cl.
*G03G 15/20* (2006.01)

(52) U.S. Cl.
CPC ..... *G03G 15/206* (2013.01)

(58) Field of Classification Search
USPC ..... 399/122, 320, 328–334; 219/216, 619
See application file for complete search history.

(56) References Cited

U.S. PATENT DOCUMENTS 5,870,660 A * 2/1999 Ito ..... H05B 6/145 219/619
6,308,039 B1 * 10/2001 Haneda ..... G03G 15/2053 399/328
2011/0064490 A1 * 3/2011 Imada ..... G03G 15/2053 399/328
2014/0255067 A1 * 9/2014 Matsunaka ..... G03G 15/2057 399/333

FOREIGN PATENT DOCUMENTS

JP 2005-338350 A 12/2005

* cited by examiner

*Primary Examiner* — Hoan Tran
(74) *Attorney, Agent, or Firm* — Canon U.S.A., Inc., IP Division

(57) ABSTRACT

An electrophotographic member includes a rubber layer having a lightness of 15 or less and including a marked portion formed so as to have a depth of 35 μm or more and 100 μm or less, a fluorine-based resin layer having a light transmittance of 60% or more, and an adhesive layer disposed between the rubber layer and the fluorine-based resin layer. The adhesive layer has a lightness of 60 or more and has a thickness of 3 μm or more and 10 μm or less in a portion surrounding the marked portion.

11 Claims, 7 Drawing Sheets

ELECTROPHOTOGRAPHIC MEMBER AND METHOD FOR PRODUCING THE SAME

BACKGROUND OF THE DISCLOSURE

Field of the Disclosure

The present disclosure relates to an electrophotographic member used in an electrophotographic image forming apparatus and a method for producing the electrophotographic member. Examples of the electrophotographic image forming apparatus include a copying machine, a printer, a facsimile, and a multifunction machine having functions of the foregoing machines.

Description of the Related Art

Electrophotographic image forming apparatuses include electrophotographic members such as a roller (e.g., fixing roller) and a belt (e.g., fixing belt) each obtained by coating a rubber layer with a fluorine-based resin.

To manage such an electrophotographic member, a marked portion (e.g., a character string such as a manufacturer's serial number) can be formed (hereafter also referred to as "marking") in the electrophotographic member.

Japanese Patent Laid-Open No. 2005-338350 discloses a method in which marking is performed on a rubber layer and then the rubber layer is coated with a fluorine-based resin. Specifically, the marking is performed by irradiating a rubber layer with iron red with laser beams. Consequently, the marked portion turns black, and thus is easily recognized visually against the surrounding bright portion with iron red.

However, when a dark (e.g., black) rubber layer is used, it is difficult to visually recognize the marked portion 1*f* the method disclosed in Japanese Patent Laid-Open No. 2005-338350 is employed.

SUMMARY OF THE DISCLOSURE

The present disclosure provides an electrophotographic member including a marked portion with good visibility and a method for producing the electrophotographic member.

Further features of the present disclosure will become apparent from the following description of exemplary embodiments with reference to the attached drawings.

DESCRIPTION OF THE EMBODIMENTS

Hereafter, an electrophotographic member according to an embodiment of the present disclosure and a method for producing the electrophotographic member will be described in detail.

Hereafter, a fixing belt used in a fixing device included in an electrophotographic image forming apparatus will be described in detail as an example of the electrophotographic member, but the electrophotographic member is not limited to such an example. For example, the electrophotographic member may be a fixing roller, a pressurizing belt, or a pressurizing roller, which are fixing members used in the fixing device. Furthermore, various structures can be replaced with other structures within the scope of the present disclosure.

(1) Image Forming Apparatus

First, the entire structure of the electrophotographic image forming apparatus (hereafter, simply referred to as an "image forming apparatus") will be described.

Figure 1:
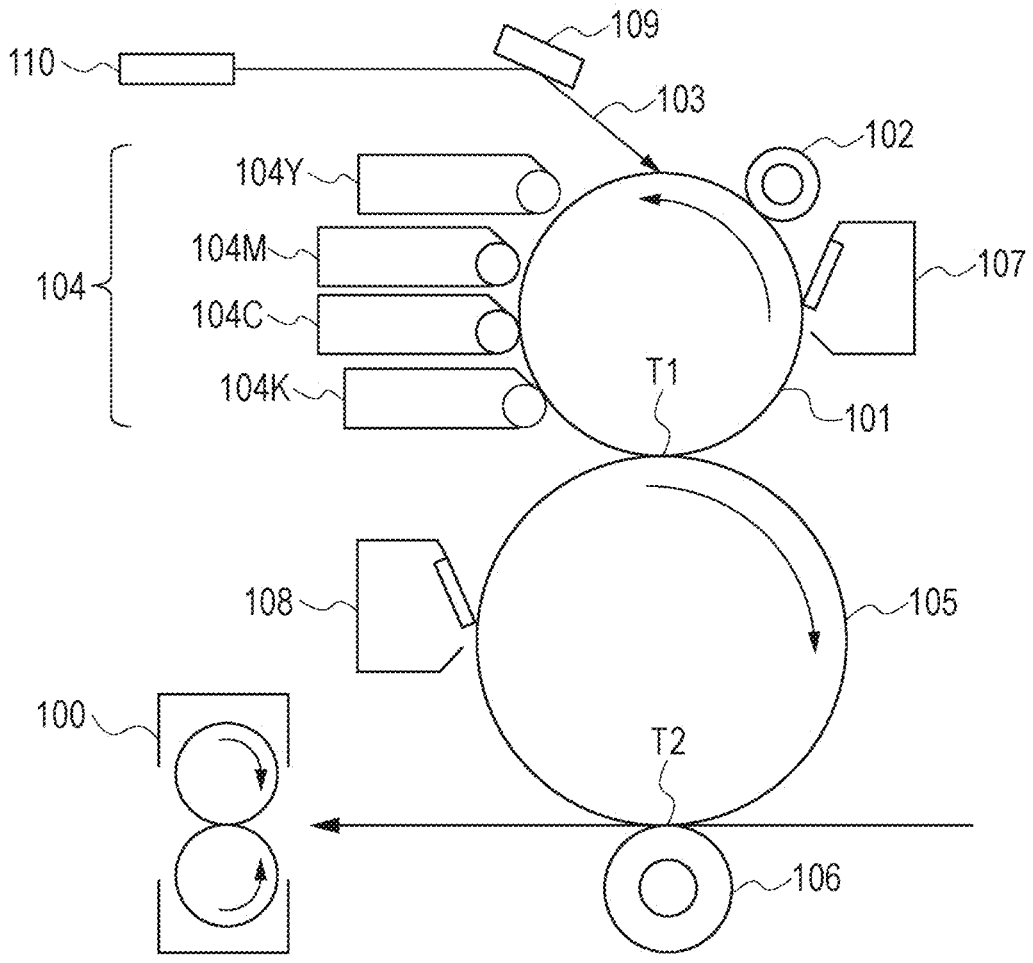
FIG. 1 is a schematic sectional view illustrating an image forming apparatus.

FIG. 1 is a schematic sectional view illustrating an image forming apparatus. A photosensitive member (image-carrying member) 101 is rotated at a predetermined process speed (peripheral speed) in a direction indicated by an arrow. Devices for forming a toner image by an electrophotographic process, such as a charging device 102, a laser beam source 110, a laser optical system 109, and a developing device 104 (104Y to 104K), are disposed around the photosensitive member 101. Furthermore, a cleaning device 107 is disposed around the photosensitive member 101.

Next, the flow of the electrophotographic process will be described. The photosensitive member 101 is uniformly charged by a charging roller 102 serving as a charging device so as to have a predetermined polarity (negative polarity in this embodiment). The charged photosensitive member 101 is then irradiated with laser beams 103 emitted from a laser beam source 110 through a laser optical system 110 in response to the input image information (information of original images) (image exposing treatment). The laser beam source 110 emits laser beams 103 modulated (on/off) on the basis of the image information, and the photosensitive member 101 is subjected to scanning exposure.

As a result, an electrostatic latent image corresponding to the image information is formed on the photosensitive member 101. The electrostatic latent image formed on the photosensitive member 101 is visualized by a developing device 104 using a toner. Specifically, a yellow toner image is formed by a developing device 104Y, and the yellow toner image is primarily transferred from the photosensitive member 101 to an intermediate transfer member 105 in a primary transfer portion T1. After the primary transfer, the toner left on the photosensitive member 101 is cleaned by a cleaning device 107.

The above-described process cycle including charging, exposure, development, primary transfer, and cleaning is repeatedly performed in the same manner to form a magenta toner image (a developing device 104M is operated), a cyan toner image (a developing device 104C is operated), and a black toner image (a developing device 104K is operated).

The four-color toner images sequentially superimposed on the intermediate transfer member 105 are secondarily transferred all together onto a recording material P in a secondary transfer portion T2. Herein, a voltage with a positive polarity is applied to a transfer roller 106 disposed so as to face the intermediate transfer member 105. After the secondary transfer, the toner left on the intermediate transfer member 105 is cleaned by a cleaning device 108.

The cleaning device 108 can be brought into contact with or separated from the intermediate transfer member 105. The cleaning device 108 is brought into contact with the intermediate transfer member 105 only when the intermediate transfer member 105 is cleaned. The transfer roller 106 can also be brought into contact with or separated from the intermediate transfer member 105. The transfer roller 106 is brought into contact with the intermediate transfer member 105 only during the secondary transfer.

Figure 2:
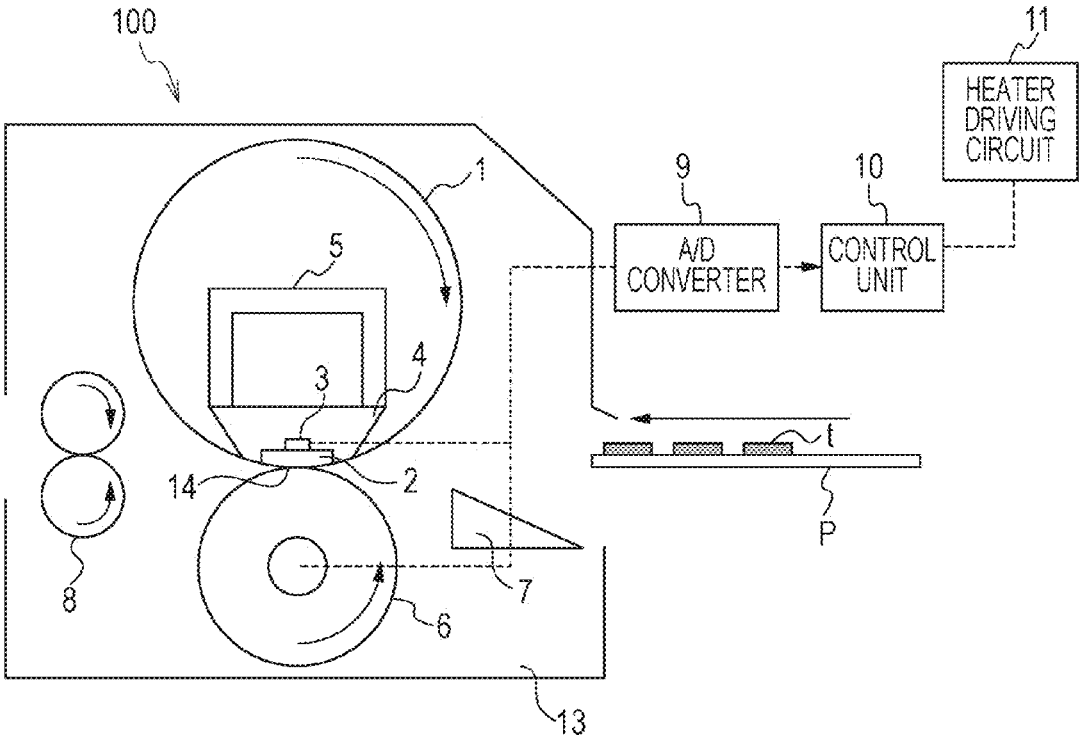
FIG. 2 is a schematic sectional view illustrating a fixing device.

The recording material P that has passed through the secondary transfer portion T2 is heated and pressurized by a fixing belt 1 and a pressurizing roller 6 of the fixing device (image heating device) 100 (FIG. 2). Thus, the recording material P is subjected to a fixing treatment (image heating treatment) of the toner image carried on the recording material P. The recording material P subjected to the fixing treatment is discharged from the image forming apparatus, and the series of the image forming operations are completed.

In this embodiment, the fixing belt 1 included in the fixing device 100 functions as an electrophotographic member.

(2) Fixing Device

FIG. 2 is a schematic sectional view illustrating the fixing device 100.

An endless fixing belt (fixing rotary member) 1 is used as an electrophotographic member.

A pressurizing roller (pressurizing rotary member) 6 is used for forming a nip portion 14 between the pressurizing roller 6 and the fixing belt 1. The pressurizing roller 6 has a multilayer structure in which a silicone rubber elastic layer having a thickness of about 3 mm and a PFA resin tube having a thickness of about 40 μm are stacked on a metal core in this order. Both ends of the metal core of the pressurizing roller 6 in the longitudinal direction are rotatably supported by a device frame 13.

When the pressurizing roller 6 is rotated by a driving motor in a direction indicated by an arrow, the fixing belt 1 that is in pressure contact with the pressurizing roller 6 is a driven belt rotated by the pressurizing roller 6. Furthermore, the fixing belt 1 has an inner surface coated with a lubricant, and thus the slidability is ensured between the fixing belt 1 and a holder 4.

A fixing heater 2 is used for heating the recording material P through the fixing belt 1. The fixing heater 2 includes an alumina substrate and a resistance heating element formed on the alumina substrate in the form of a film having a thickness of about 10 μm by applying a conductive paste containing a silver-palladium alloy using a screen printing method. The resistance heating element is further coated with pressure glass, and thus the fixing heater 2 is a ceramic heater. The fixing heater 2 also has a function as a pressing member that presses the fixing belt 1 toward the pressurizing roller 6.

A holder 4 is used for holding the fixing heater and is formed of a liquid crystal polymer resin having high heat resistance. A metal stay 5 is used for supporting the holder 4. Both ends of the metal stay 5 in the longitudinal direction are urged toward the pressurizing roller 6 at a total pressure of 313.6 N (32 kgf) with a pressurizing mechanism.

A temperature sensor 3 is used for detecting the temperature of the fixing heater 2, and is connected to a control unit (CPU) 10 through an A/D converter 9. The temperature sensor 3 outputs a temperature detection signal to the control unit 10. The control unit 10 samples the output from the temperature sensor 3 at a predetermined interval to reflect the thus-obtained temperature information on the temperature control. That is, the control unit 10 controls the energization for the fixing heater 2 on the basis of the output from the temperature sensor 3 so that the temperature of the fixing heater 2 reaches a target temperature using a heater driving circuit 11.

A guide 7 is used for guiding the recording material P toward the nip portion 14. A pair of conveying rollers 8 are used for conveying the recording material P immediately after the fixing treatment.

(2-1) Fixing Belt

Figure 3:
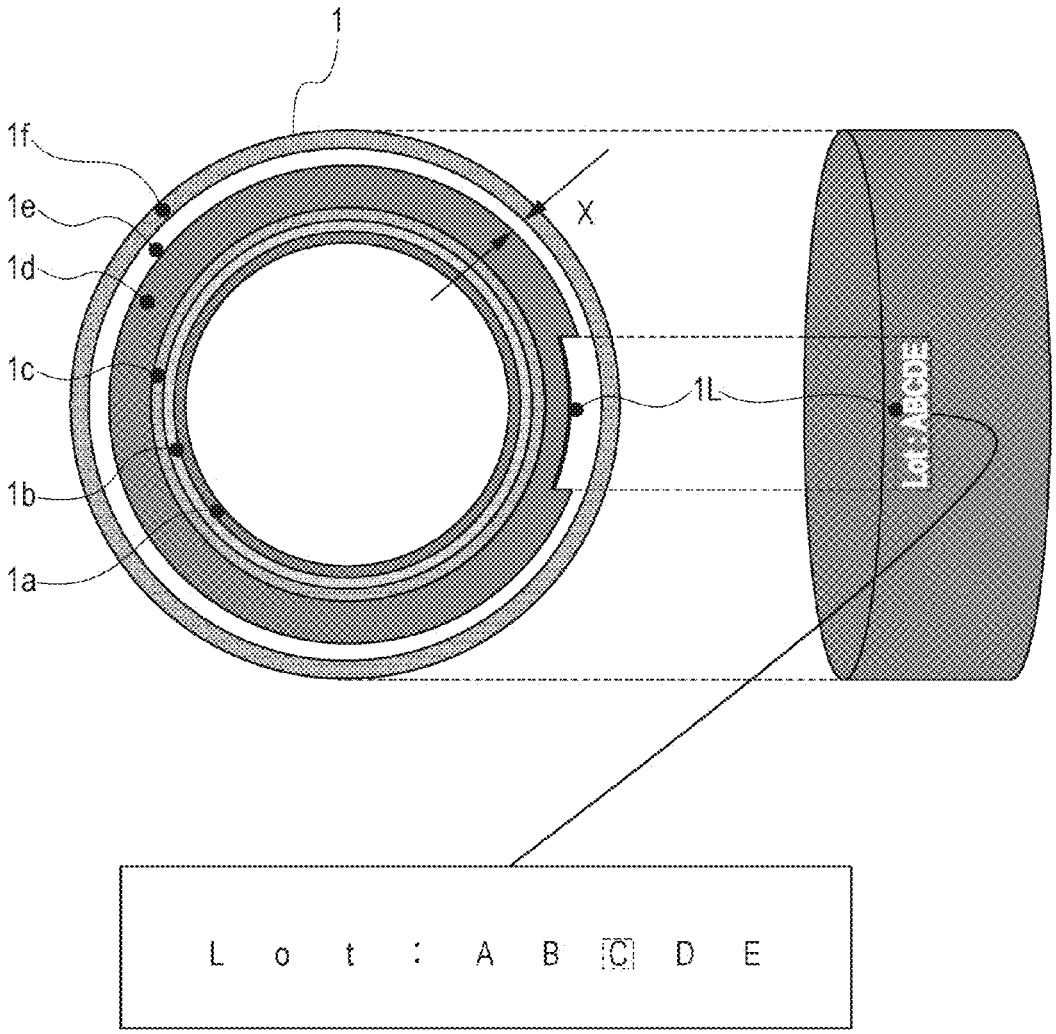
FIG. 3 schematically illustrates a fixing belt.

FIG. 3 schematically illustrates the fixing belt 1.

The fixing belt 1 includes a cylindrical base member 1*b* and an inner sliding layer 1*a* disposed on the inner circumferential surface of the cylindrical base member 1*b*. Herein, the inner sliding layer 1*a* is disposed to improve the slidability with the fixing heater 2. If the slidability is not necessarily improved, the inner sliding layer may be omitted.

A silicone rubber elastic layer 1*d* (hereafter, simply referred to as a "rubber layer" or an "elastic layer") is disposed so as to coat the outer circumferential surface of the cylindrical base member 1*b*, and a primer layer 1*c* is disposed between the cylindrical base member 1*b* and the silicone rubber elastic layer 1*d*. The rubber layer 1*d* includes a marked portion (also referred to as a "recessed portion") 1L formed through a laser marking treatment (heat treatment). The marked portion indicates the letter/symbol for managing the fixing belt 1, such as a manufacturer's serial number (management number). In this embodiment, "Lot: ABCDE" is marked.

The marked portion 1L is not limited to the above example as long as the marked portion 1L is used to indicate some intention/instruction for operators/assemblers, such as an arrow that indicates an assembly direction or a picture that indicates an assembly procedure in the production/assembly.

A fluorine-based resin layer (release layer) 1*f* is disposed on the outer circumferential surface of the rubber layer 1*d* in which the marked portion 1L has been formed, with a whitish adhesive layer 1*e* disposed therebetween.

Hereafter, each layer of the fixing belt 1 will be described in detail.

(2-1-1) Cylindrical Base Member

Since the fixing belt 1 needs to have heat resistance, the cylindrical base member 1*b* is particularly a base member made of metal (also referred to as a "metal base member") whose heat resistance and bending resistance are taken into consideration. The reason for which a base member made of metal but not resin is employed is to prevent formation of a through-hole in the fixing belt 1 when a marking treatment that uses laser beams described below is performed.

The metal base member can be prepared by nickel electroforming as described in Japanese Patent Laid-Open No. 2002-258648 and Japanese Patent Laid-Open No. 2005-121825. The resin base member having heat resistance can be made of a polyimide resin, a polyamide-imide resin, or a polyether ether ketone resin as described in Japanese Patent Laid-Open No. 2005-300915 and Japanese Patent Laid-Open No. 2010-134094.

In this embodiment, a metal base member made of a nickel-iron alloy and having an inside diameter of ϕ30 mm, a thickness of 40 μm, and a length of 400 mm is used as the cylindrical base member.

(2-1-2) Inner Sliding Layer

The inner sliding layer 1*a* is suitably made of a resin having high durability and high heat resistance, such as a polyimide resin, a polyamide-imide resin, or a polyether ether ketone resin. In particular, a polyimide resin is used in terms of ease of production, heat resistance, modulus of elasticity, strength, and the like. The polyimide resin is formed from a polyimide precursor solution obtained by reacting an aromatic tetracarboxylic dianhydride or a derivative thereof and an aromatic diamine in a substantially equimolar amount in an organic polar solvent. Specifically, the polyimide resin can be formed by coating the inner surface of the cylindrical base member 1*b* with the polyimide precursor solution and performing drying and heating to cause a dehydration ring closure reaction.

The coating method is a ring coating method. The cylindrical base member 1*b* whose inner surface has been coated is dried for 30 minutes in, for example, a hot-air circulating oven at 60° C. and then fired for 10 to 60 minutes in a hot-air circulating oven at 200° C. to 240° C., which is a temperature range in which the fatigue strength of the cylindrical base member does not decrease. As a result, a polyimide inner sliding layer can be formed by the dehydration ring closure reaction.

(2-1-3-1) Rubber Layer

The silicone rubber elastic layer 1*d* is disposed to impart flexibility so that the fixing belt 1 can follow the projections and depressions of paper fibers constituting the recording material. Furthermore, the fixing belt 1 needs to have a function of supplying a sufficient amount of heat without delay to the recording material (toner image) in the nip portion 14. Therefore, the thermal effusivity ($b=(\lambda \cdot Cp \cdot \rho)^{0.5}$) of the elastic layer is improved by increasing the thermal conductivity and the volumetric heat capacity.

Figure 5:
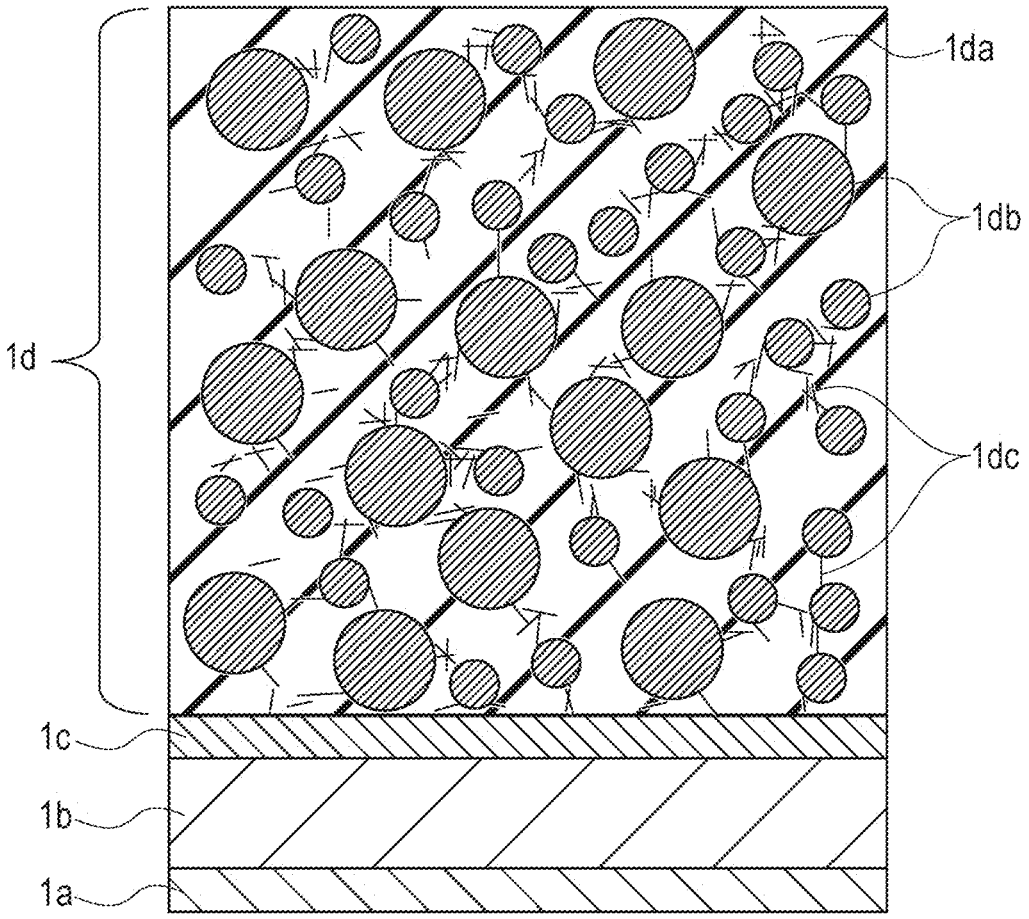
FIG. 5 schematically illustrates a layer structure of a fixing belt.

In this embodiment, as illustrated in FIG. 5 that shows the layer structure of the fixing belt 1, the silicone rubber elastic layer 1*d* is a rubber layer that achieve flexibility and heat supply capacity. Specifically, the rubber layer is a silicone rubber elastic layer formed by adding a fiber 1*dc* made of carbon (hereafter, referred to as a "carbon fiber") and an inorganic filler 1*db* to a base material 1*da* formed of an addition-curable silicone rubber and then curing the resulting mixture.

The addition-curable silicone rubber serving as the base material 1*da* contains an organopolysiloxane having an unsaturated aliphatic group, an organopolysiloxane having active hydrogen bonded to silicon, and a platinum compound serving as a cross-linking catalyst. The organopolysiloxane having active hydrogen bonded to silicon reacts with an alkenyl group in the organopolysiloxane having an unsaturated aliphatic group through the catalysis of the platinum compound to form a cross-linking structure.

The carbon fiber 1*dc* and the inorganic filler 1*db* are added in consideration of the balance between thermal conductivity, heat capacity, flexibility, and the like. When the amount of the inorganic filler 1*db* added is increased, the thermal conductivity and the heat capacity improve, but the flexibility tends to degrade. Therefore, a heat transfer path is formed between particles of the inorganic filler 1*db* using the carbon fiber 1*dc* to prevent loss of flexibility, and the ratio of the amount of the base material 1*da* to the total amount of the carbon fiber 1*dc* and the inorganic filler 1*db* is increased. Consequently, a rubber layer 1*d* having good balance with flexibility can be formed.

The carbon fiber 1*dc* is, for example, carbon fiber or carbon nanotube. In this embodiment, carbon fiber is used.

When the carbon fiber 1*dc* is added in such a manner, the lightness (L*) of the rubber layer is 15 or less. The lightness (L*) is defined in the CIE Lab (L*ab* colorimetric system) color space. When the differences in L (lightness), a* (hue of red-green axis), and b* (hue of yellow-blue axis) between targets are assumed to be ΔL*, Δa*, and Δb*, the color difference is defined as $(\Delta L^{*2}+\Delta a^{*2}+\Delta b^{*2})^{1/2}$. The visibility tends to improve as the color difference increases. The lightness (L*) can be measured with PIAS manufactured by Quality Engineering Associates, Inc. (QEA).

The inorganic filler 1*db* is, for example, silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe), or nickel (Ni). In this embodiment, aluminum (Al) is used.

The inorganic fillers 1*db* may be used alone or in combination of two or more. The average diameter of the inorganic filler 1*db* is, for example, 1 μm or more and 50 μm or less in terms of ease of handling and dispersibility. The inorganic filler 1*db* may be a spherical inorganic filler, a pulverized inorganic filler, a plate-shaped inorganic filler, or a whisker-shaped inorganic filler. In particular, the inorganic filler 1*db* is a spherical inorganic filler in terms of dispersibility.

For this reason, the thickness of the silicone rubber elastic layer 1*d* is preferably 100 μm or more and 500 μm or less and more preferably 200 μm or more and 400 μm or less.

(2-1-3-2) Coating Method of Rubber Layer

Figure 6:
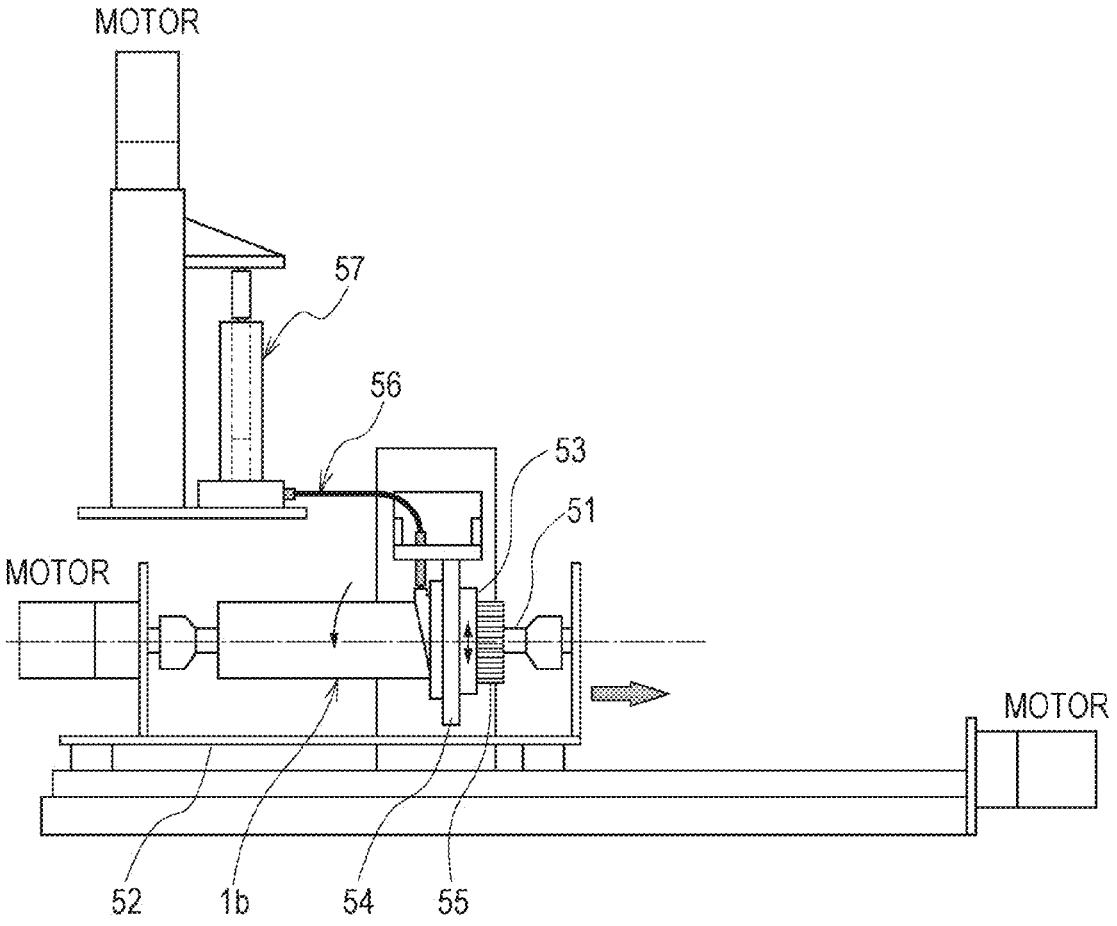
FIG. 6 schematically illustrates a coating apparatus that uses a ring coating method.

FIG. 6 illustrates an apparatus used for coating the cylindrical base member 1*b* (base member) with the silicone rubber elastic layer 1*d*. In this embodiment, a ring coating method is employed. This corresponds to a first step in FIG. 7A.

An addition-curable silicone rubber composition containing an addition-curable silicone rubber and an inorganic filler is charged into a cylinder pump 57 by turning a motor on. The addition-curable silicone rubber composition charged into the pump 57 is pressure-fed to a coating head 54 through a pressure feed tube 56. The addition-curable silicone rubber composition is then applied onto the outer circumferential surface of the cylindrical base member 1*b* from a coating liquid supply nozzle 53 located inside the coating head 54.

The cylindrical base member 1*b* is integrated with a cylindrical metal core 51 inserted into the cylindrical base member 1*b*. That is, the cylindrical base member 1*b* is rotated by rotating the cylindrical metal core 51 with a motor while the coating liquid is supplied. Furthermore, the cylindrical base member 1*b* is slid together with the cylindrical metal core 51 at a constant speed in the right direction (FIG. 6) using a slider 52 with another motor. As a result, the entire region of the cylindrical base member 1*b* is coated with the addition-curable silicone rubber composition, and thus a coating film is formed.

The thickness of the coating film can be controlled by the clearance between the coating liquid supply nozzle and the cylindrical base member 1*b*, the supply rate of the silicone rubber composition, and the moving speed of the cylindrical base member 1*b*. In this embodiment, the clearance between the coating liquid supply nozzle and the cylindrical base member 1*b* is set to be 400 μm, the supply rate of the silicone rubber composition is set to be 2.8 mm/s, and the moving speed of the cylindrical base member 1*b* is set to be 30 mm/s. Thus, a silicone rubber composition layer 55 having a thickness of 300 μm is formed.

The addition-curable silicone rubber composition layer 55 formed on the cylindrical base member 1*b* is heated in an electric furnace for a predetermined time to cause a cross-linking reaction (curing) to proceed. Thus, the silicone rubber elastic layer 1*d* can be formed.

To improve the adhesiveness between the cylindrical base member 1*b* and the silicone rubber elastic layer 1*d*, the cylindrical base member 1*b* is desirably subjected to a primer treatment (application of an adhesive) in advance. The primer (adhesive) 1*c* used needs to have better wettability with the cylindrical base member 1*b* than the silicone rubber elastic layer 1*d*. Examples of the primer 1*c* include hydrosilyl (SiH) silicone primers, vinyl silicone primers, and alkoxy silicone primers. In this embodiment, a silicone primer is used. The thickness of the primer layer 1*c* is, for example, 0.5 to 5.0 μm for the purpose of suppressing unevenness and producing adhesiveness.

(2-1-3-3) Marking Treatment on Rubber Layer

In this embodiment, a visible marked portion (recessed portion) 1L is formed in the rubber layer 1*d* to, for example, manage the fixing belt 1. Therefore, a marking treatment that uses laser beams is performed in this embodiment. This corresponds to a second step in FIG. 7A.

The marking treatment that uses laser beams provides higher productivity than a marking treatment that uses a cutting tool or the like because there is no need to replace consumable parts. The marking treatment that uses laser beams is also advantageous in that an object subjected to the marking treatment does not deform due to pressing because the object can be processed without contact. Examples of the laser include a YAG laser, a $YAVO_4$ laser, and a $CO_2$ laser.

By irradiating the circumferential surface of the silicone rubber elastic layer 1*d* with laser beams, the depth of the marked portion 1L is preferably set to be 35 μm or more and 100 μm or less. The depth of the marked portion 1L is more preferably set to be 50 μm or more.

This is because, if the depth of the marked portion 1L is less than 35 μm, a whitish adhesive described below substantially does not enter the marked portion 1L, which degrades the visibility of the marked portion 1L. Furthermore, if the depth of the marked portion (recessed portion) 1L is more than 100 μm, air left in the recessed portion cannot be completely squeezed out because of the step height between the recessed portion and its surrounding portion in a step of squeezing the adhesive disposed between the fluorine-based resin layer 1*f* and the silicone rubber elastic layer 1*d*. Consequently, air bubbles may be left between the rubber layer 1*d* and the fluorine-based resin layer 1*f*.

Thus, in this embodiment, a $CO_2$ laser having a wavelength of 10.6 μm, an output of 20 W, and an oscillation frequency of 25 kHz is used. The depth of letters constituting the marked portion 1L is 50 μm and the font size is 3×3 mm (one letter).

(2-1-4) Adhesive Layer

The adhesive layer 1*e* is disposed between the silicone rubber elastic layer 1*d* and a fluorine-based resin tube serving as the fluorine-based resin layer 1*f* so as to fix the silicone rubber elastic layer 1*d* and the fluorine-based resin layer 1*f*.

The adhesive layer 1*e* is formed by applying an adhesive to the cured silicone rubber elastic layer 1*d*. This corresponds to a third step in FIG. 7A.

The rubber layer 1*d* on which the adhesive layer 1*e* has been formed is then coated with the fluorine-based resin tube 1*f*. By squeezing the adhesive present between the rubber layer 1*d* and the fluorine-based resin tube 1*f*, the thickness of the adhesive layer 1*e* is made substantially uniform over the entire region. This squeezing step corresponds to a seventh step in FIG. 7B.

As illustrated in FIG. 3, the thickness X (the thickness of a region that surrounds the marked portion 1L; in this embodiment, the thickness of a region other than the marked portion 1L) of the adhesive layer 1*e* after the squeezing step is, for example, 3 μm or more and 10 μm or less. Note that the adhesive enters the recessed portion constituting the marked portion 1L so as to fill the gap. In other words, the adhesive is applied so as to enter the recessed portion 1L formed through the laser marking treatment.

Herein, when the marked portion 1L is constituted by letters, the region that surrounds the marked portion 1L, which is a region where the adhesive layer 1*e* needs to have the thickness X, at least includes a square region on which one letter is circumscribed (e.g., a region that surrounds the letter "C" indicated by a dotted line in FIG. 3).

The adhesive constituting the adhesive layer 1*e* is an addition-curable silicone rubber adhesive, which is a whitish adhesive. Specifically, the addition-curable silicone rubber adhesive contains an organopolysiloxane having an unsaturated hydrocarbon group such as a vinyl group, an organohydrogenpolysiloxane, and a platinum compound serving as a cross-linking catalyst. The addition-curable silicone rubber adhesive is cured by an addition reaction.

The adhesive constituting the adhesive layer 1*e* is a whitish adhesive to achieve the visibility against the black silicone rubber elastic layer 1*d* containing carbon by causing the adhesive to enter the recessed portion 1L formed through the laser marking treatment. Specifically, the lightness (L*) is 60 or more. The lightness (L*) is the same index as the lightness (L*) of the rubber layer 1*d*, and can be measured with the same instrument.

In this embodiment, the silicone rubber elastic layer 1*d* containing carbon has a dark color such as black compared with the intrinsic color of silicone rubber (iron red), and thus the lightness (L*) is low (lightness (L*): 15 or less). Therefore, in the case where the background color is a color of the silicone rubber elastic layer 1*d*, when the marked portion (letter portion) 1L is a white letter portion whose lightness (L*) of the L*ab color space is large (lightness (L*): 60 or more), the color difference (dE) increases and the visibility of the marked portion 1L considerably improves.

In this embodiment, for the purpose of achieving good visibility of the marked portion 1L, the difference in lightness (L*) between the rubber layer 1*d* and the adhesive layer 1*e* is, for example, 45 or more.

The coloring agent contained in the adhesive is a white pigment such as titanium oxide (titanium white), flowers of zinc (zinc white), lithopone, and white lead.

In this embodiment, an addition-curable silicone rubber adhesive "DOW CORNING (R) SE 1819 CV A/B (manufactured by Dow Corning Toray Co., Ltd.)" is used as the adhesive that satisfies above conditions.

(2-1-5) Fluorine-Based Resin Layer

In this embodiment, a fluorine-based resin tube is used as the fluorine-based resin layer (release layer) 1*f*. The fluorine-based resin tube is made of, for example, a tetrafluoroethylene-perfluoro(alkyl vinyl ether) copolymer (PFA), polytetrafluoroethylene (PTFE), or a tetrafluoroethylene-hexafluoropropylene copolymer (FEP). In this embodiment, PFA is used in view of moldability and toner releasability.

The thickness of the fluorine-based resin layer 1*f* is, for example, 50 μm or less. This is because, when the fluorine-based resin layer 1*f* is stacked on the rubber layer 1*d*, the elasticity of the rubber layer 1*d* serving as a lower layer can be maintained and an excess increase in the surface hardness of the fixing belt 1 can be suppressed. The inner surface of the fluorine-based resin tube 1*f* can be subjected to a sodium treatment, an excimer laser treatment, an ammonia treatment, or the like in advance to improve the adhesiveness.

The light transmittance (visible light transmittance) of the fluorine-based resin layer 1*f* is, for example, 60% or more. This is because the visibility of the marked portion 1L located below the fluorine-based resin layer 1*f* is prevented from being degraded. The light transmittance can be measured with an ultraviolet-visible-near infrared (UV-Vis-NIR) spectrophotometer. The phrase "the light transmittance (visible light transmittance) is 60% or more" means that the transmittance in the entire wavelength region of 380 nm to 750 nm is 60% or more in the obtained spectrum data.

(3) Production Process of Fixing Belt

Figures 7A, 7B:
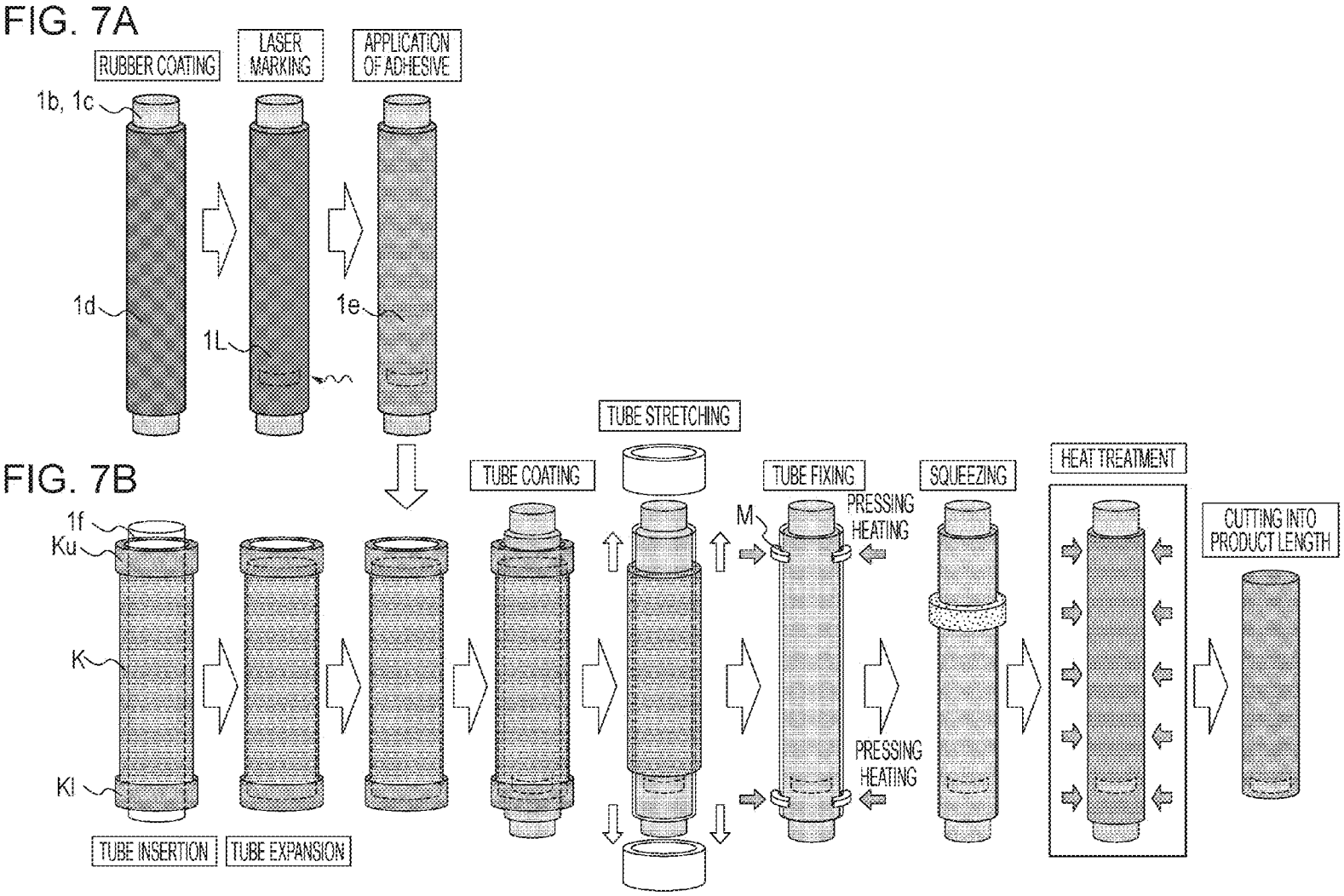
FIG. 7A schematically illustrates a production process of a fixing belt from rubber coating to application of an adhesive, and FIG. 7B schematically illustrates a production process of the fixing belt from tube insertion to cutting into a product length.

FIGS. 7A and 7B illustrate the flow of production of the fixing belt. FIG. 7A illustrates three steps from the coating with the rubber layer 1*d* to the application of the adhesive. FIG. 7B illustrates nine steps from the coating with the fluorine-based resin tube 1*f* to the cutting into a product length.

The three steps in FIG. 7A have been described above. Hereafter, the nine steps in FIG. 7B will be described in detail. This embodiment employs a method (expansion coating method) in which coating is performed from the outside of the rubber layer 1*d* while the fluorine-based resin tube 1*f* is expanded.

In the first step in FIG. 7B, the fluorine-based resin tube 1*f* is inserted into a metal expansion mold K having an inside diameter larger than the outside diameter of the cylindrical base member 1*b* on which the rubber layer 1*d* has been stacked. Both ends of the fluorine-based resin tube 1*f* in the longitudinal direction are held by using holding members Ku and Kl.

In the second step, a vacuum (negative pressure relative to atmospheric pressure) is formed in a gap portion between the outer surface of the fluorine-based resin tube 1*f* and the inner surface of the expansion mold K. In the vacuum (5 kPa), the fluorine-based resin tube 1*f* is expanded in the radial direction and thus the outer surface of the fluorine-based resin tube 1*f* is brought into close contact with the inner surface of the expansion mold K.

In the third step, the intermediate product formed through the three steps in FIG. 7A, that is, the cylindrical base member 1*b* on which the rubber layer 1*d* has been stacked is inserted into the expansion mold K. The outer surface of the rubber layer 1*d* is uniformly coated with the addition-curable silicone rubber adhesive, and the addition-curable silicone adhesive also enters the recessed portion 1L.

In the fourth step, after the cylindrical base member 1*b* on which the rubber layer 1*d* has been stacked is placed inside the expanded fluorine-based resin tube 1*f*, the vacuum (negative pressure relative to atmospheric pressure) in the gap portion between the outer surface of the fluorine-based resin tube 1*f* and the inner surface of the expansion mold K is released.

When the vacuum is released, the increased diameter of the fluorine-based resin tube 1*f* decreases to a diameter substantially equal to the outside diameter of the cylindrical base member 1*b* on which the rubber layer 1*d* has been stacked. Thus, the fluorine-based resin tube 1*f* and the rubber layer 1*d* are brought into close contact with each other.

In the fifth step, the fluorine-based resin tube 1*f* is stretched in the longitudinal direction to a predetermined stretching ratio. When the fluorine-based resin tube 1*f* is stretched, the adhesive present between the fluorine-based resin tube 1*f* and the rubber layer 1*d* serves as a lubricant, and thus the fluorine-based resin tube 1*f* can be smoothly stretched. In this embodiment, the stretching ratio of the fluorine-based resin tube 1*f* in the longitudinal direction is 8%. As a result of stretching the fluorine-based resin tube 1*f* in the longitudinal direction in such a manner, creases are not easily formed on the fluorine-based resin tube 1*f* while the fixing device is operated. Consequently, a fixing belt having high durability can be produced.

In the sixth step, since a force is exerted on the fluorine-based resin tube 1*f* so that the length of the fluorine-based resin tube 1*f* returns to the original length, the fluorine-based resin tube 1*f* is temporarily fixed by being pressed and heated from the outside using a metal piece M including a heater. The temperature of the metal peace M during the pressing/heating is 200° C. and the pressing/heating time is 20 seconds.

In the seventh step, an excess amount of the adhesive present between the rubber layer 1*d* and the fluorine-based resin layer 1*f* is squeezed out. Through the squeezing step, the thickness X (FIG. 3) of the adhesive layer 1*e* is in the range of 3 μm or more and 10 μm or less.

In the eighth step, a heat treatment is performed in an electric furnace for a predetermined time. As a result, the adhesive is cured to form an adhesive layer 1*e*.

In the final step, the fixing belt 1 is cut into a desired length.

Through the above steps, the fixing belt 1 is produced.

Hereafter, the effects of this embodiment will be investigated based on Examples 1 and 2 and Comparative Example.

Example 1

An N-methyl-2-pyrrolidone solution of a polyimide precursor made of 3,3',4,4'-biphenyltetracarboxylic dianhydride and p-phenylenediamine was prepared as a polyimide precursor solution. The precursor solution was applied onto an inner surface of a cylindrical base member 1*b* made of a nickel-iron alloy and having an inside diameter of ϕ30 mm, a thickness of 40 μm, and a length of 400 mm, and fired at 200° C. for 20 minutes to perform imidation. Thus, an inner sliding layer 1*a* having a thickness of 20 μm was formed.

A hydrosilyl-based silicone primer (DY39-051 A/B manufactured by Shin-Etsu Chemical Co., Ltd.) was applied onto the surface of the cylindrical base member 1*b* and fired at 200° C. for 5 minutes.

An addition-curable silicone rubber (rubber layer 1*d*) was applied onto the silicone primer so as to have a thickness of 300 μm and fired at 200° C. for 30 minutes. The addition-curable silicone rubber is obtained by adding an inorganic filler and a carbon fiber to an undiluted addition-curable silicone rubber liquid (a liquid prepared by equally mixing an "A liquid" and a "B liquid" of SE1886 (trade name) manufactured by Dow Corning Toray Co., Ltd.). Specifically, high-purity spherical alumina (trade name: "Alunabeads CB-A25BC" manufactured by Showa Titanium Co., Ltd.) was added as the inorganic filler so that the volume ratio of the spherical alumina was 25% relative to the cured rubber layer 1*d*. Subsequently, a carbon fiber (trade name: "VGCF-S" manufactured by SHOWA DENKO K.K.) produced by a vapor deposition method was further added so as to have a volume ratio of 2.0%, and kneading was performed. The lightness (L*) of the rubber layer 1*d* was 5 because of the addition of the carbon fiber.

After the temperature was decreased to room temperature, a portion (near one end of the rubber layer in the longitudinal direction) to be a non-image-forming region of the formed rubber layer 1*d* was irradiated with laser beams using ML-G9300 manufactured by KEYENCE CORPORATION to form a marked portion 1L. As a result, the depth of the marked portion 1L was 50 μm.

An addition-curable silicone rubber adhesive (obtained by equally mixing an "A liquid" and a "B liquid" of SE1819CV (trade name) manufactured by Dow Corning Toray Co., Ltd.) containing a white pigment and thus having a lightness (L*) of about 80 to 95 was prepared and applied.

The adhesive constituting an adhesive layer 1*e* was substantially uniformly applied so as to have a thickness of about 10 μm.

Subsequently, a fluorine-based resin tube having a length of 400 mm, an inside diameter of 29 mm, and a thickness of 25 μm was prepared as a fluorine-based resin layer 1*f* and stacked thereon. The fluorine-based resin tube used was obtained by extruding a fluorine-based resin pellet (trade name: Teflon PFA451HPJ manufactured by Du Pont-Mitsui Fluorochemicals Company, Ltd.). The light transmittance (visible light transmittance) of the fluorine-based resin layer 1*f* was 70%.

An excess amount of the adhesive was then removed by uniformly squeezing the fluorine-based resin tube 1*f* to sufficiently decrease the thickness of the adhesive layer 1*e*. Subsequently, heating was performed for one hour in an electric furnace whose temperature was set to 200° C. to cure the adhesive. Thus, the fluorine-based resin tube 1*f* was adhered to the rubber layer 1*d*.

Consequently, the difference in lightness (L*) between the rubber layer 1*d* and the adhesive was 75 or more. Since the marked portion 1L had a white color as opposed to a black color of the background and the light transmittance of the fluorine-based resin layer 1*f* was high, a fixing belt 1 having a marked portion 1L with excellent visibility could be produced.

Example 2

Example 2 was the same as Example 1, except that the adhesive used was prepared by adding 5 wt % of alumina serving as a pigment to a transparent addition-curable silicone rubber adhesive (obtained by equally mixing an "A liquid" and a "B liquid" of SE1740 (trade name) manufactured by Dow Corning Toray Co., Ltd.).

When alumina was added in such a manner, the adhesive turned pink and the lightness (L*) of the adhesive was about 60 to 75. That is, the difference in lightness (L*) between the rubber layer 1*d* and the adhesive was 55 or more. Even if such an adhesive was used, the marked portion 1L had a pink color as opposed to a black color of the background and furthermore the light transmittance of the fluorine-based resin layer 1*f* was high. Therefore, a fixing belt 1 having a marked portion 1L with good visibility could be produced.

Comparative Example

Figure 4:
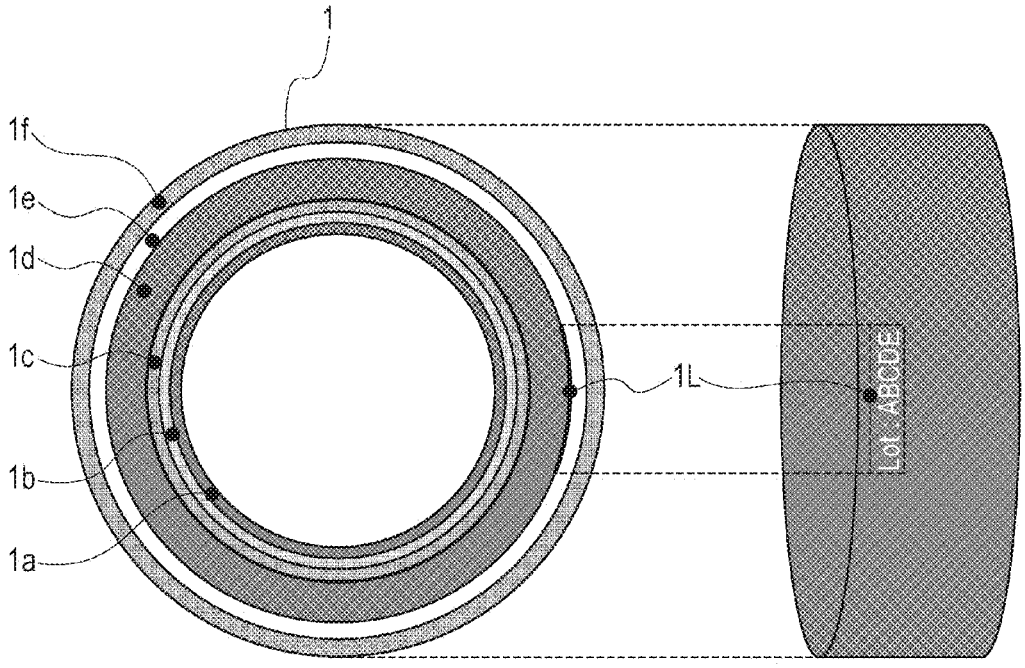
FIG. 4 schematically illustrates a fixing belt.

Comparative Example will be described with reference to FIG. 4. FIG. 4 schematically illustrates a fixing belt.

Comparative Example was the same as Example 1, except that the adhesive used was prepared by adding 5 wt % of iron red serving as a pigment to a transparent addition-curable silicone rubber adhesive (obtained by equally mixing an "A liquid" and a "B liquid" of SE1740 (trade name) manufactured by Dow Corning Toray Co., Ltd.).

When iron red was added in such a manner, the adhesive turned reddish brown and the lightness (L*) of the adhesive was about 25 to 40. Consequently, the difference in lightness (L*) between the rubber layer 1*d* and the adhesive was 20 to 35.

In Comparative Example, as illustrated in FIG. 4, the marked portion 1L had a reddish brown color similar to a black color of the background. Thus, the difference in lightness (L*) decreases, which makes it difficult to distinguish the letters constituting the marked portion 1L.

Table collectively shows the investigation results of Examples 1 and 2 and Comparative Example.

TABLE

| | Coloring agent of adhesive | Color of adhesive | Lightness (L*) | Visibility |
|---|---|---|---|---|
| Example 1 | Titanium oxide | White | 80 to 95 | A |
| Example 2 | Alumina | Pink | 60 to 75 | B |
| Comparative Example | Iron red | Reddish brown | 25 to 40 | C |

A: Excellent
B: Good
C: Poor

In Examples 1 and 2, when a dark (black) rubber layer 1*d* is used, the marked portion 1L is brightly viewed compared with the surrounding portion (high contrast), and thus the visibility is improved. In contrast, in Comparative Example, when a dark (black) rubber layer 1*d* is used, the marked portion 1L is not brightly viewed compared with the surrounding portion (low contrast), and thus the visibility is poor.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-044051, filed Mar. 5, 2015, which is hereby incorporated by reference herein in its entirety.

What is claimed is:

1. An electrophotographic member comprising:

a rubber layer having a lightness of 15 or less and comprising a marked portion formed so as to have a depth of 35 μm or more and 100 μm or less;

a fluorine-based resin layer having a light transmittance of 60% or more; and an adhesive layer disposed between the rubber layer and the fluorine-based resin layer, the adhesive layer having a lightness of 60 or more and having a thickness of 3 μm or more and 10 μm or less in a portion surrounding the marked portion.

2. The electrophotographic member according to claim 1, wherein the marked portion has a depth of 50 μm or more.

3. The electrophotographic member according to claim 1, wherein the rubber layer comprises carbon.

4. The electrophotographic member according to claim 1, wherein the adhesive layer comprises a white pigment.

5. The electrophotographic member according to claim 1, comprising a metal base member, wherein the rubber layer is disposed on the base member.

6. The electrophotographic member according to claim 1, wherein the electrophotographic member is a rotary member configured to fix a toner image on a recording material.

7. A method for producing an electrophotographic member, comprising the steps of:

forming a marked portion in a rubber layer having a lightness of 15 or less so that the marked portion has a depth of 35 μm or more and 100 μm or less;

applying an adhesive having a lightness of 60 or more to an outer circumferential surface of the rubber layer;

coating the outer circumferential surface of the rubber layer with a fluorine-based resin tube having a light transmittance of 60% or more;

performing squeezing so that the adhesive disposed between the rubber layer and the fluorine-based resin tube has a thickness of 3 μm or more and 10 μm or less in a portion surrounding the marked portion; and curing the adhesive disposed between the rubber layer and the fluorine-based resin tube.

8. The method according to claim 7, wherein the marked portion is formed in the rubber layer so as to have a depth of 50 μm or more.

9. The method according to claim 7, wherein the marked portion is formed by irradiating the rubber layer with laser beams.

10. The method according to claim 7, further comprising forming the rubber layer having a lightness of 15 or less on a metal base member.

11. The method according to claim 7, wherein the electrophotographic member is a rotary member configured to fix a toner image on a recording material.

* * * * *